US011118334B2

(12) United States Patent
Hennes

(10) Patent No.: US 11,118,334 B2
(45) Date of Patent: Sep. 14, 2021

(54) ODOR TRAP DEVICE FOR SANITARY FIXTURES, IN PARTICULAR URINALS

(71) Applicant: Viega Technology GmbH & Co. KG, Attendorn (DE)

(72) Inventor: Frank Hennes, Finnentrop (DE)

(73) Assignee: Viega Technology GmbH & Co. KG, Attendorn (DE)

( * ) Notice: Subject to any disclaimer, the term of this patent is extended or adjusted under 35 U.S.C. 154(b) by 55 days.

(21) Appl. No.: 16/614,968

(22) PCT Filed: Jul. 13, 2018

(86) PCT No.: PCT/EP2018/069116
§ 371 (c)(1),
(2) Date: Nov. 19, 2019

(87) PCT Pub. No.: WO2019/020403
PCT Pub. Date: Jan. 31, 2019

(65) Prior Publication Data

US 2020/0173153 A1 Jun. 4, 2020

(30) Foreign Application Priority Data

Jul. 24, 2017 (EP) ..... 17182791

(51) Int. Cl.
*E03C 1/28* (2006.01)
*E03D 13/00* (2006.01)

(52) U.S. Cl.
CPC ..... *E03C 1/281* (2013.01); *E03D 13/007* (2013.01)

(58) Field of Classification Search
USPC ..... 4/695
See application file for complete search history.

(56) References Cited

U.S. PATENT DOCUMENTS

| | | | |
|---|---|---|---|
| 8,365,319 | B2 | 2/2013 | Park |
| 9,951,503 | B2 | 4/2018 | Kosarnig |
| 10,294,550 | B2 | 5/2019 | Ju et al. |

FOREIGN PATENT DOCUMENTS

| | | | |
|---|---|---|---|
| CH | 18657 | A | 2/1899 |
| CH | 710071 | B1 | 3/2016 |
| EP | 2426281 | A2 | 3/2012 |
| EP | 2840191 | A1 | 2/2015 |
| SU | 108408 | A1 | 11/1956 |
| WO | 2017120593 | A1 | 7/2017 |

*Primary Examiner* — Christine J Skubinna
(74) *Attorney, Agent, or Firm* — The Webb Law Firm

(57) ABSTRACT

The invention relates to an odor trap device for sanitary fixtures, in particular urinals, having a drainage element which has a pipe section, the pipe section defining a sealing wall, having a sealing diaphragm which is in sealing contact with the sealing wall in a closed position and is pushed away from the sealing wall into an open position when fluid, such as urine, is present, and having a holder for mounting the sealing diaphragm relative to the sealing wall. In order to minimise the risk of odor formation in an odor trap device of this kind and also to reliably discharge small quantities of urine or liquid present, it is provided, in accordance with the invention, that the sealing diaphragm is fixed on the holder, the holder being supported below the sealing diaphragm.

15 Claims, 8 Drawing Sheets

ODOR TRAP DEVICE FOR SANITARY FIXTURES, IN PARTICULAR URINALS

CROSS-REFERENCE TO RELATED APPLICATIONS

This application is the United States national phase of International Application No. PCT/EP2018/069116 filed Jul. 13, 2018, and claims priority to European Patent Application No. 17182791.8 filed Jul. 24, 2017, the disclosures of which are hereby incorporated by reference in their entirety.

BACKGROUND OF THE INVENTION

Field of the Invention

The invention relates to an odor trap device for sanitary fixtures, in particular urinals, preferably waterless urinals, having a drainage element which has a pipe section, the pipe section defining a sealing wall, having a sealing diaphragm which is in sealing contact with the sealing wall in a closed position and is pushed away from the sealing wall into an open position when fluid, such as urine, is present, and having a holder for mounting the sealing diaphragm relative to the sealing wall, the sealing diaphragm is fixed on the holder, the holder being supported below the sealing diaphragm.

Description of Related Art

Odor trap devices for waterless sanitary objects are known in various designs. Waterless means that no flushing water is used for flushing the sanitary object, for example a urinal or a sanitary drain basin. The waterless flushing is carried out by an appropriate design of the components of the sanitary object and the odor trap device, whereby the liquid to be discharged, in particular urine, flows out of the sanitary object due to gravity.

EP 2 840 191 A1 discloses an odor trap device for urinals, which comprises a drainage element having a sealing wall, a sealing membrane and a bearing element for mounting the sealing diaphragm relative to the sealing wall. In a closed position, the sealing diaphragm is sealingly in contact with the sealing wall and in the presence of urine or another liquid is pushed away from the sealing wall from the closed position into an open position, whereby a gap is formed between the sealing diaphragm and the sealing wall through which the liquid flows. The sealing diaphragm has a sealing surface which runs parallel to the sealing wall, whereby the sealing surface lies flat against the sealing wall. The sealing diaphragm, as seen in the discharge direction, has a barrel-shaped accumulation section in front of the sealing surface, the diameter of which decreases with increasing distance from the sealing surface. The bearing element has a flat bearing plate with radially outwardly extending bearing webs by means of which the bearing plate is supported in the discharge element. In order to prevent the sealing diaphragm from being pressed on and thus opened in the event of a back pressure in the waste water system, the accumulation section of the sealing diaphragm is supported on the bearing webs. This known odor trap has numerous dead spaces in front of the odor trap whereby the risk of odor formation consists. In particular, the gap between the sealing diaphragm and the sealing wall only forms when a relatively large amount of urine or liquid is present, whereby there is the risk of odor formation.

CH 18 657 A discloses an odor trap device, among other things for urinals, having a drainage element which has a pipe section, the pipe section has at its lower end a circumferential, radially inwardly projecting shoulder, in which a conical, a valve seat defining drain opening is formed. The conical drain opening is associated with a mushroom-shaped valve body which is mounted on a coil spring, which is supported on a bracket which is attached via two rods to the shoulder of the pipe section. The bias of the coil spring is selected such that the pressure of the valve body on the valve seat is sufficient on the one hand, so that the trap device closes gas-tight, and on the other hand opens under the weight of a water column of a few millimeters.

From WO 2017/120593 A1 a bell-shaped sealing valve for a waterless urinal is known, which is made of an elastic material. In this case, the sealing valve has on its inside vertically extending ribs which extend in a sealing region of the sealing valve and serve as a structural support of the sealing valve. The outside of the valve seals against an inner wall of a cartridge. Such a cartridge is arranged below a drain of a urinal and connected to a drainage line.

The present invention is based on the object of creating a device of the type mentioned at the outset, in which the risk of odor formation is minimised and in which even small amounts of urine or liquid are reliably discharged.

SUMMARY OF THE INVENTION

According to the invention, a sealing diaphragm is fixed on a holder, wherein the holder is supported below the sealing diaphragm, the number and/or size of dead spaces in front of the odor barrier is reduced and thus the risk of odor formation is minimised. In particular, the proposed solution makes it possible to arrange the sealing diaphragm relative to the holder and the sealing wall in such a way that even small quantities of urine or liquid can be reliably discharged. According to the invention, the holder is in contact with the pipe section below the sealing diaphragm.

In contrast to the odor trap device known from EP 2 840 191 A1, the device according to the invention does not require an accumulation section of the sealing diaphragm to be supported on bearing webs of the holder in order to prevent the sealing diaphragm from being pressed on and thus opened in the event of a back pressure in the waste water system. Rather, the solution according to the invention minimizes the contact area of the sealing diaphragm on its holder, whereby the number or size of dead spaces in front of the odor barrier can be considerably reduced and thus the risk of odor formation can be minimized. In particular, with the solution according to the invention the inlet area at the accumulation section of the sealing diaphragm can be designed in such a way that even small amounts of urine or liquid can be reliably discharged.

An advantageous embodiment of the invention is characterised in that the sealing diaphragm has a rubber-elastic, upwardly tapering accumulation section and a rubber-elastic, substantially hollow-cylindrical section adjoining the accumulation section as seen in the discharge direction, the outside of the accumulation section delimiting with the pipe section an annular, uninterrupted inlet channel which tapers towards zero as seen in the discharge direction. This allows small amounts of urine or liquid to be discharged very safely and reliably. Preferably, the inlet channel for this purpose is substantially gusset-shaped in cross-section, in that the accumulation section has a spherical section-shaped or domed outer surface and thereby defines an arcuate outer contour when viewed in cross-section, while the pipe section has a cylindrical inner surface and thereby defines a straight line when viewed in cross-section, which touches the arcuate outer contour.

A further advantageous embodiment of the invention is characterized in that the pipe section of the drainage element has on its inside inlet channels which, starting from the inlet opening of the pipe section, extend substantially vertically in the direction of the sealing wall and end above a sealing surface defined by the sealing wall. The inlet channels are preferably formed radially into the inside of the pipe section.

According to a further configuration of the odor trap device according to the invention, the sealing diaphragm and the height of the holder are dimensioned such that, in the mounted state of the odor trap device, a substantially hollow-cylindrical section of the sealing diaphragm extends from the lower edge of the sealing diaphragm into an inlet funnel formed on the discharge element.

A further advantageous embodiment of the invention provides for that the substantially hollow cylindrical section of the sealing diaphragm delimits with a rounded transition of the inlet funnel in the direction of the pipe section an annular inlet channel which tapers towards zero when viewed in the discharge direction. The annular inlet channel is preferably radially and axially extended by the inlet channels mentioned above, which extend substantially vertically.

A further advantageous embodiment of the invention provides for that the sealing diaphragm is fixed to a projection of the holder, the projection being arranged on the upper side of the holder and having an annular groove or undercut to which the sealing diaphragm is sealingly buttoned. This allows the sealing diaphragm to be connected to the holder in a simple and reliable manner and, if necessary, also loosened for maintenance purposes.

The protrusion of the holder, to which the sealing diaphragm is fixed, is preferably plate-shaped or button-shaped, whereby the protrusion defines an annular groove in which the sealing diaphragm engages in a sealing manner.

According to a further embodiment of the invention the holder has a domed or spherical segment section on which the sealing diaphragm rests. This embodiment improves the dimensional stability of the sealing diaphragm in its closed position.

For a high discharge performance, i.e. a high discharge volume flow, it is advantageous if the holder has, according to a further embodiment, support legs which are arranged at a distance from the inner surface of the sealing diaphragm and project downwards with respect to a lower edge of the sealing diaphragm. Preferably the holder has at least three such support legs, preferably evenly spaced from each other.

It is advantageous for the stability of the holder if the support legs, according to a further embodiment, are connected to one another by transverse struts. Preferably the transverse struts are arranged below the lower edge of the sealing diaphragm when the odor trap device is fully assembled.

With regard to a material-saving design of the holder with good dimensional stability, it is advantageous if the support legs have, in accordance with a further embodiment, an outwardly angled or obliquely outwardly extending leg section.

A further embodiment of the odor trap device according to the invention is characterised in that the pipe section has recesses in which the holder engages. This allows the holder and thus the sealing membrane to be positioned optimally and reliably in relation to the sealing wall defined by the pipe section. Preferably the support legs protrude outwards from the transverse struts and define projections which engage in the recesses of the pipe section. The recesses are preferably designed as downward open recesses on the lower edge of the pipe section.

According a further advantageous embodiment of the odor trap device according to the invention, a hood-shaped or cap-shaped cover is arranged above the drainage element, which is detachably connected to the drain element (directly or indirectly) via spacers. By means of the cover the visual appearance and hygienic impression conveyed by the odor trap can be positively effected. In particular, the colour of the odor trap can be easily adapted to different sanitary ceramic colours by means of the cover. However, the cover can also be made in a contrasting colour or have a metallic surface, for example chrome-plated surface. Preferably the cover is designed in such a way that it laterally projects beyond the drainage element along its entire outer periphery. The cover can define an annular gap as an outlet gap for urine or another liquid by means of a flange-shaped part of the odor trap, for example an adapter that can be inserted into a profile gasket or screwed in.

A further embodiment of the odor trap device according to the invention is characterised in that the pipe section is inserted into a pipe section extension, the pipe section extension being detachably connected to the pipe section and/or the drain element. A flow resistance can be provided by the pipe section extension, by means of which an accumulation zone for the liquid is created. If the liquid column in this accumulation zone is sufficiently high, the liquid pressure increases to such an extent that the liquid will flow out of this zone. Due to the gravity of the liquid flowing off, a suction effect is created which pulls the liquid above the sealing surface of the odor trap more quickly downwards into the pipe section extension.

For this purpose, the pipe section extension can preferably have a baffle element or deflection element at its lower end, which acts as flow resistance. For example, the baffle element or deflection element is domed or conical with the tip of the domed element or cone pointing upwards. The baffle element or deflection element may be connected to a hollow cylindrical section of the pipe section extension by a number of substantially vertically extending retaining webs.

Another advantageous embodiment of the pipe section extension is characterized in that the baffle element or deflection element is formed from a flap-shaped extension of the pipe section extension, this extension projecting downwards relative to the lower end of the tubular section of the pipe section extension and being angled obliquely in the direction of the pipe centre axis. In this case the baffle element or deflection element is preferably substantially disc-shaped. This embodiment is advantageous with regard to a simple, cost-effective production of the pipe section extension and the baffle element or deflection element.

Preferably, the pipe section extension is substantially straight. In this case, it requires only little radial installation space (space) for its arrangement in a sanitary object, in particular in a urinal.

A further embodiment of the pipe section extension provides for that it has a shoulder on the inside on which the holder is supported. This embodiment creates a simple possibility for axial fixing of the holder. The shoulder can also serve for axial fixation of the pipe section of the drainage element. The shoulder is preferably designed as a circumferential shoulder.

For a quick, tool-free connection of the drainage element and the pipe section extension, these have according to another preferred embodiment latching elements assigned to one another. For a reliable and low-play, preferably backlash-free connection of drainage element and pipe section extension, the latching elements can be latched together preferably by a rotational movement of the drainage element relative to the pipe section extension.

BRIEF DESCRIPTION OF THE DRAWINGS

In the following, the invention is explained in more detail on the basis of a drawing depicting several design examples. In the drawing.

DESCRIPTION OF THE INVENTION

A first example of the present invention is shown in FIGS. 1 to 8.

Figure 2:
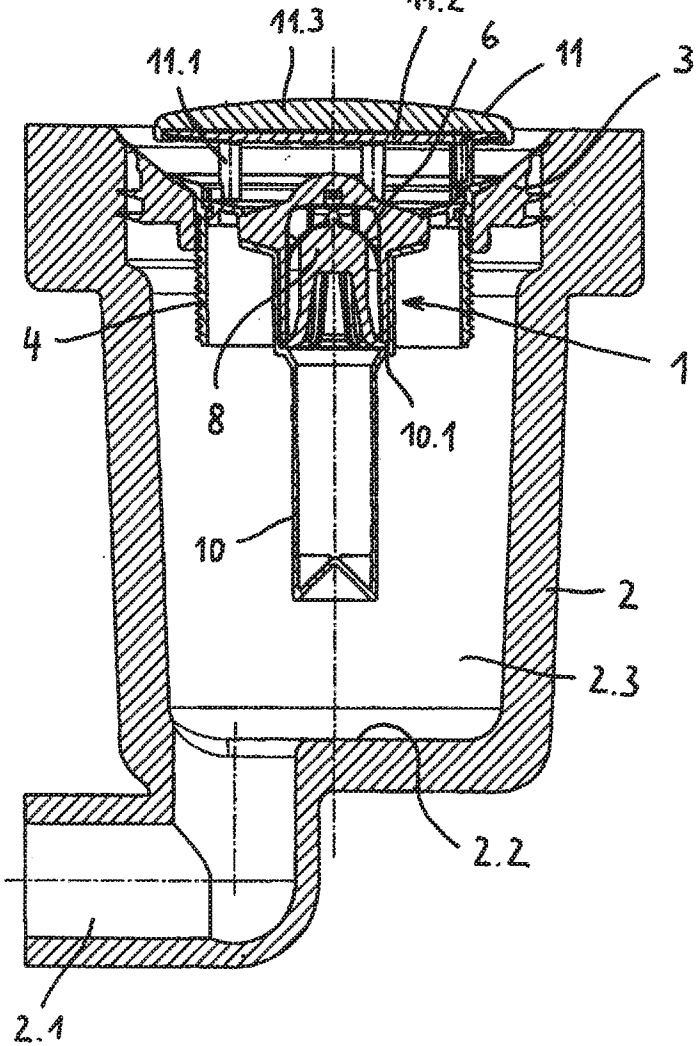
FIG. 2 shows the sanitary object with installed odor trap device from FIG. 1 in a vertical sectional view.

In the drawing an odor trap device 1 is shown, which is intended for a sanitary object 2, which may be a urinal or other sanitary drain basin. In FIG. 2, the odor trap device 1 is installed in the sanitary object 2. Through the odor trap device 1, liquid, such as urine, is led from the sanitary object 2 to a drain pipe 2.1. The odor trap device 1 prevents odors from rising from the drain pipe 2.1 to the outside or the surroundings of the sanitary object 2.

The odor trap device 1 is preferably intended for use in sanitary articles operated without flushing water, in particular in urinals operated without flushing water. However, it can also be operated with flushing water.

Figure 1:
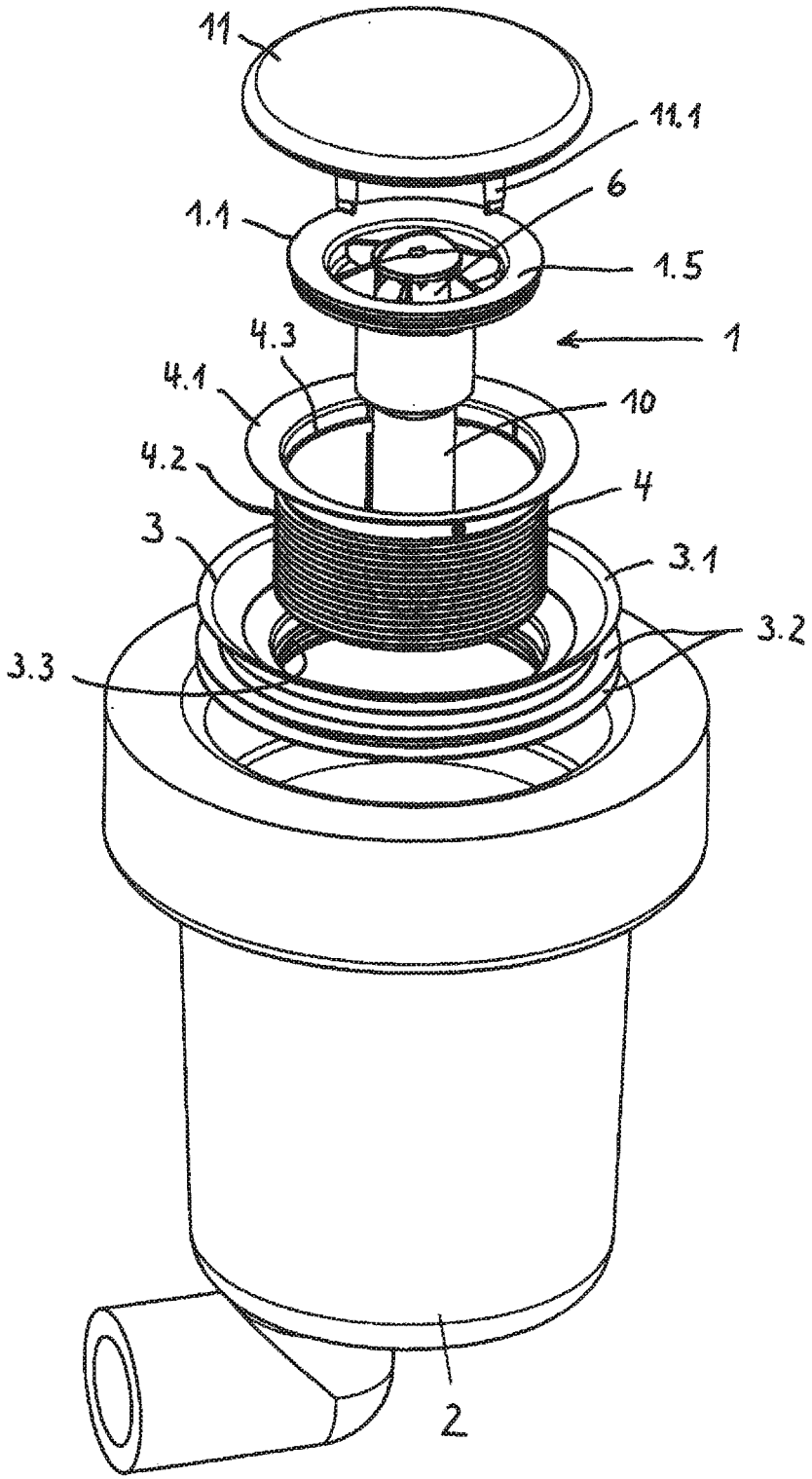
FIG. 1 shows a schematic representation of a sanitary object with an odor trap device and optional accessories in a perspective exploded view.
Figure 3:
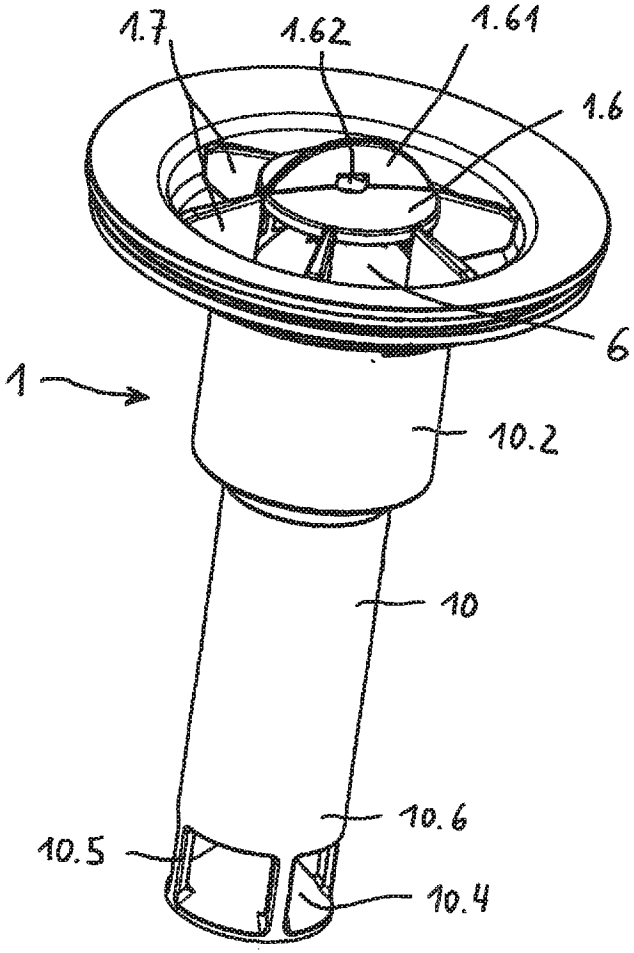
FIG. 3 shows the odor trap device from FIGS. 1 and 2 in a perspective view.

In the embodiment shown in FIGS. 1 and 2, the odor trap device 1 is installed in the sanitary object 2 using an annular profile seal 3 and an adapter 4 comprising a circumferential sealing flange 4.1. The profile seal 3 is preferably made of rubber-elastic material and has radially projecting sealing lips 3.1, 3.2 on its outer circumference. The adapter 4 is designed as a ring or bushing and is inserted into the profile seal 3. It is made of relatively hard material, for example stainless metal or hard plastic, and has an external thread 4.2 which can be screwed into an internal thread 3.3 formed on the inner circumference of the profile seal 3.

The odor trap device 1 comprises a drainage element 1.1 with a pipe section 1.2 which defines a sealing wall 1.3. The pipe section 1.2 is formed cylindrical, preferably circular cylindrical. An inlet funnel 1.4 is integrally formed on the pipe section 1.2, which has a circumferential mounting flange 1.5 at its upper end. The upper side of the mounting flange 1.5 is conical and descends from the outer circumference in the direction of the central axis of the pipe section 1.2. An axial projection 1.51 is formed on the underside of the mounting flange 1.5, which is radially offset inwards in relation to the outer circumference of the mounting flange 1.5. The axial projection 1.51 is preferably ring-shaped and has a circumferential annular groove 1.52 on its outside, into which a (not shown) sealing ring (e.g. an O-ring) can be inserted.

The annular or bush-shaped adapter 4 has on its inside a circumferential shoulder 4.3, on which the drainage element 1.1 with its mounting flange 1.5 rests, so that the drainage element 1.1 is positively held, in particular axially supported in the adapter 4. Above the inlet funnel 1.4 the drainage element 1.1 has a projection 1.61 which can be used as a handle for handling the drainage element 1.1 during its assembly or disassembly. The upwardly protruding projection 1.61 is located on the top of a plate-shaped part 1.6 of the drainage element. The projection (handle) 1.61 is, for example, web-shaped or shaped as a circular disc segment. It has a horizontal through opening 1.62 which overlaps a vertical through opening 1.63 formed in the plate-shaped part 1.6. The plate-shaped part 1.6 of the drainage element is formed preferably substantially circular, the projection (handle) 1.61 ending at the circumference of part 1.6. The plate-shaped part 1.6 is arranged at a distance from the inlet opening 5 of the pipe section 1.2 and is formed on webs 1.7, which in turn are formed on the inner surface of the inlet funnel 1.4.

Furthermore, the odor trap device 1 comprises a sealing diaphragm 6 which is in sealing contact with the sealing wall 1.3 of the drainage element 1.1 in a sealing position and is pushed away from the sealing wall 1.3 into an open position by the presence of liquid, such as urine. A holder 8 is provided to support the sealing diaphragm 6 relative to the sealing wall 1.3. The holder 8 can also be referred to as the seal socket. The sealing diaphragm 6 is fixed on the holder 8, wherein the holder 8 is supported below the sealing diaphragm and is in contact with the pipe section 1.2.

The sealing diaphragm 6 has a rubber-elastic, upwardly tapering accumulation section 6.1 and an adjacent, substantially hollow-cylindrical, rubber-elastic section 6.2 seen in the direction of flow. The holder 8 has a domed section 8.1 on which the sealing diaphragm 6 rests. The diameter of the domed section 8.1 is considerably smaller than the radial distance of the webs 1.7 on which the plate-shaped part 1.6 of the drainage element 1.1 is formed.

The accumulation section 6.1 of the sealing diaphragm 6 is, in the example shown, substantially in the form of a semi-spherical shell. However, accumulation section 6.1 may also have another domed shape, for example substantially the shape of a rotationally symmetrical paraboloid, or be substantially bell-shaped. The domed section 8.1 of the holder 8, on which the sealing diaphragm 6 with the accumulation section 6.1 rests, is preferably adapted to the shape of the accumulation section 6.1. In the example shown, section 8.1 of holder 8 is substantially formed in the shape of a spherical shell segment.

The sealing diaphragm 6 is fixed to a pin-shaped projection 8.2 of the holder 8, wherein the projection 8.2 is arranged on the upper side or tip of the holder 8 and has an annular groove or undercut 8.21 to which the sealing diaphragm 6 is sealingly buttoned. For this purpose the sealing diaphragm 6 has a through opening 6.3, which is preferably surrounded by a collar 6.4 formed on the sealing diaphragm (see in particular FIGS. 4 and 6).

The holder 8 has substantially vertical support webs or support legs 8.3, which are arranged in a spaced manner to the inner surface 6.5 of the sealing diaphragm 6 and protrude downwards from a lower edge 6.6 of the sealing diaphragm 6. In the embodiment shown, the holder 8 has six support webs or support legs 8.3. Alternatively, the holder 8 can also have a different number of such support legs 8.3. Preferably, however, it comprises at least three support legs. The support legs 8.3 are preferably equally spaced from one another.

The support legs 8.3 are connected to one another by transverse struts 8.4. The transverse struts 8.4 are arranged below the lower edge 6.5 of the sealing diaphragm 6 when the odor trap device 1 is fully assembled. They are preferably of circular arc design and together with the support legs 8.3 form a closed circular ring (see FIG. 4). The support legs 8.3 each have a leg section 8.31 angled outwards or running obliquely outwards. The lower ends of the support legs 8.3 or leg sections 8.31 protrude radially from the transverse struts 8.4.

The pipe section 1.2 of the drainage element 1.1 has recesses 1.21 into which the holder 8 engages in a positive fit. The recesses 1.21 open out at the lower edge 1.22 of the pipe section 1.2. When mounted, the holder 8 engages with its lower, radially projecting ends (projections) 8.32 in the recesses 1.21.

Figure 7:
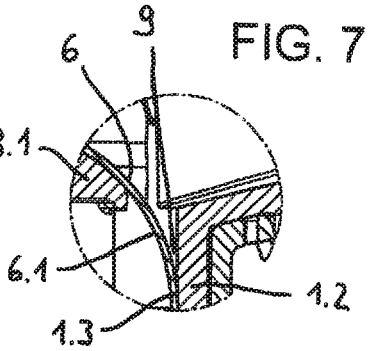
FIG. 7 shows an enlarged view of detail B from FIG. 5.
Figure 5:
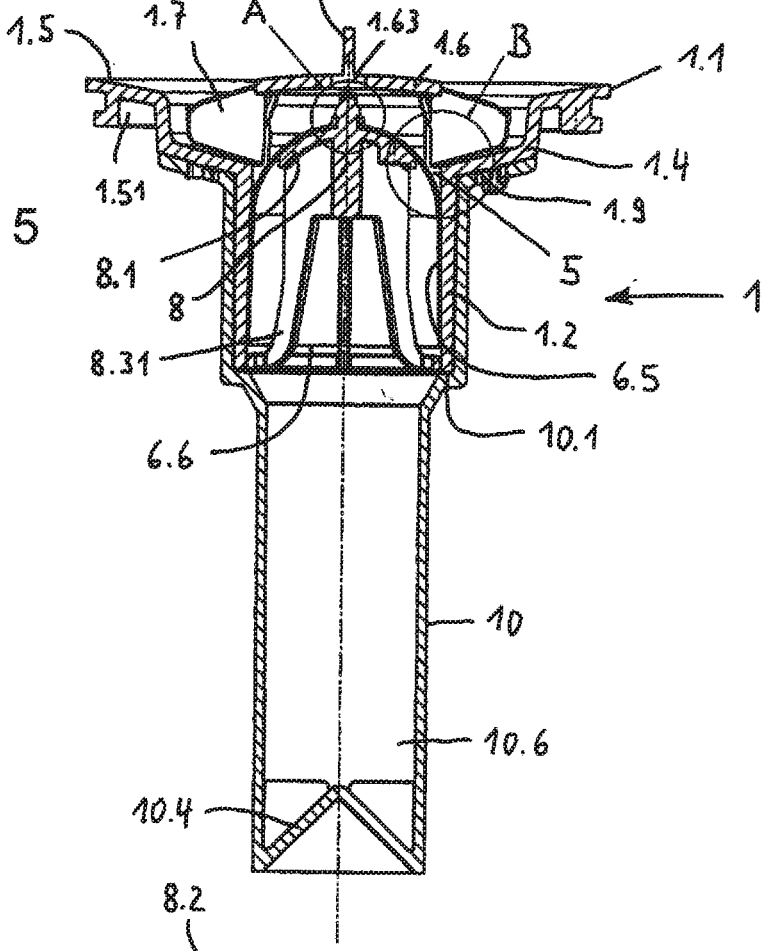
FIG. 5 shows the odor trap device from FIGS. 1 and 2 in a vertical sectional view.
Figure 8:
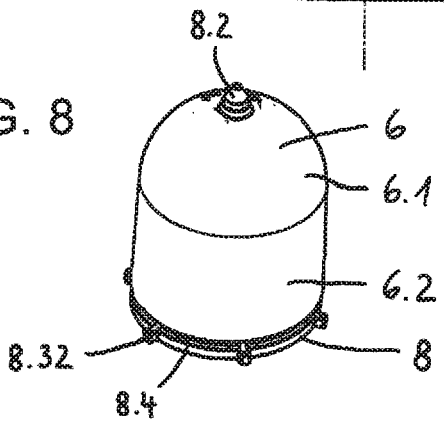
FIG. 8 shows the sealing diaphragm of the odor trap device from FIGS. 1 and 2 fixed on the holder in perspective.
Figure 9:
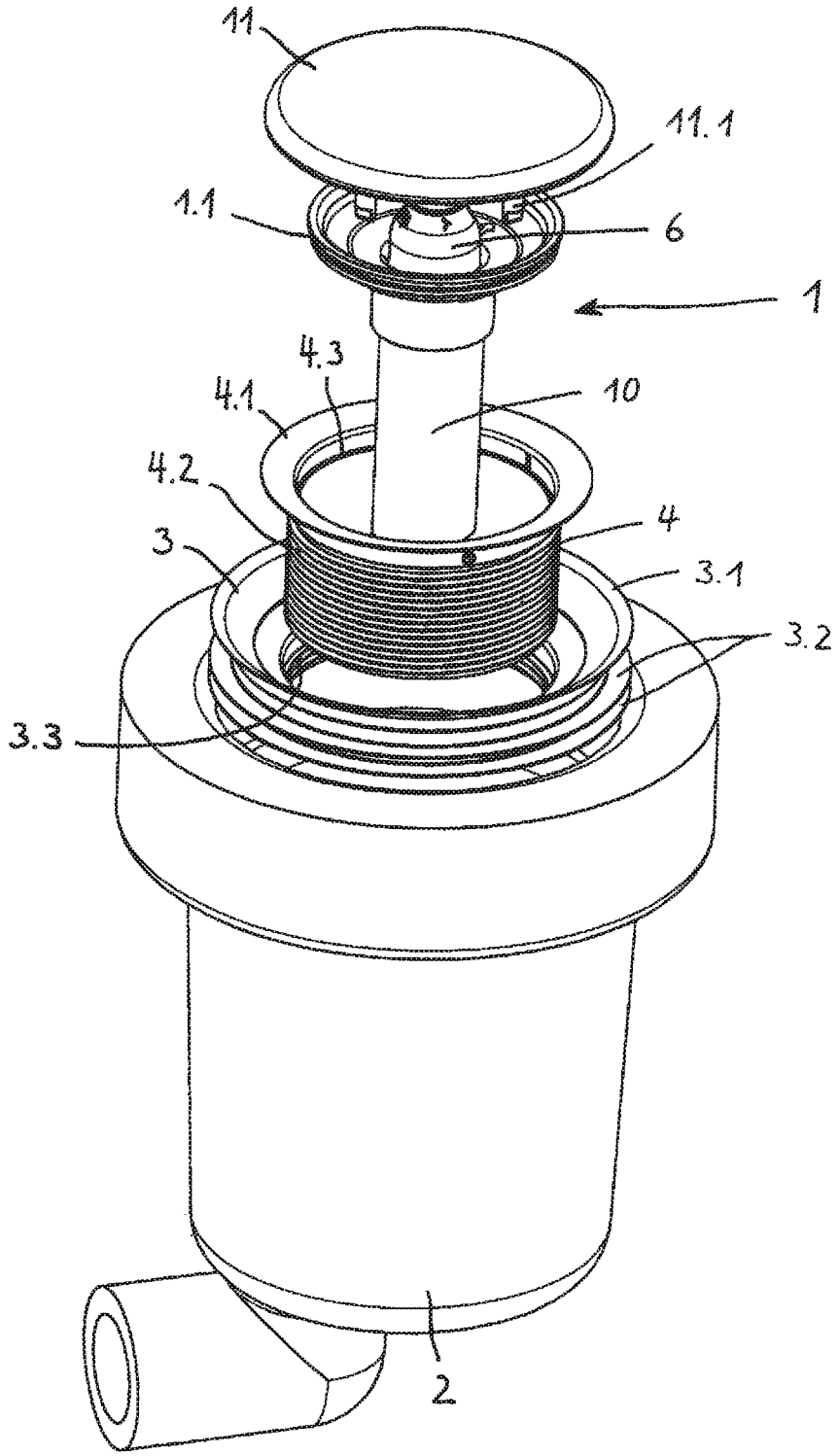
FIG. 9 shows a schematic representation of a sanitary object with an odor trap device and optional accessories in a perspective explosion view.
Figure 11:
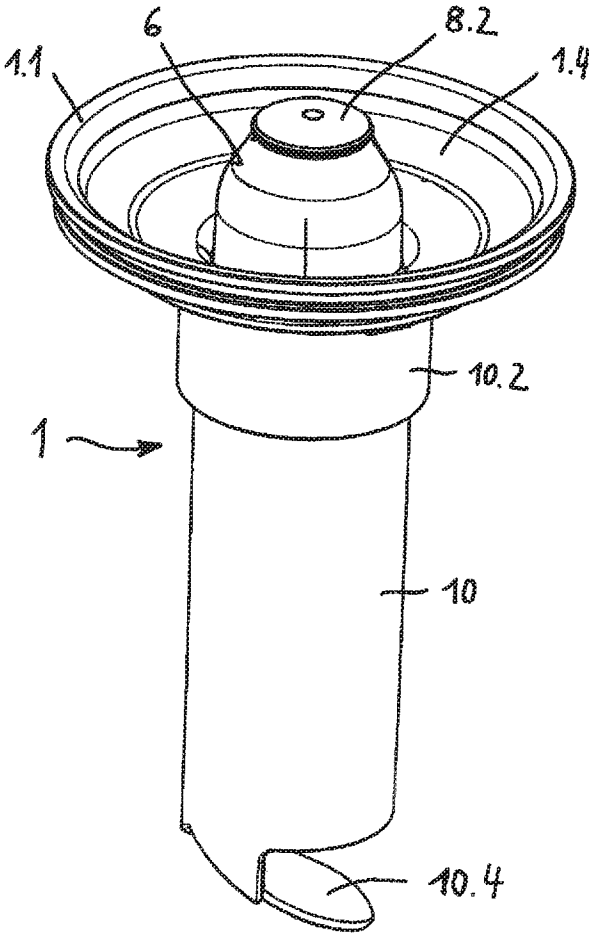
FIG. 11 shows the odor trap device from FIGS. 9 and 10 in a perspective view.
Figure 10:
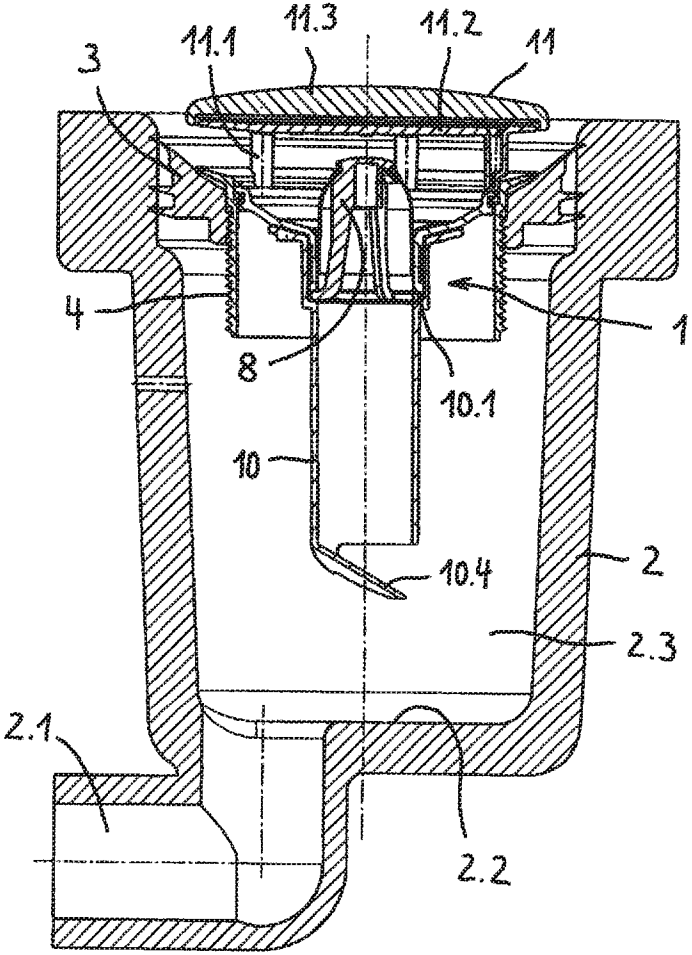
FIG. 10 shows the sanitary object with mounted odor trap device from FIG. 9 in a vertical sectional view.
Figure 12:
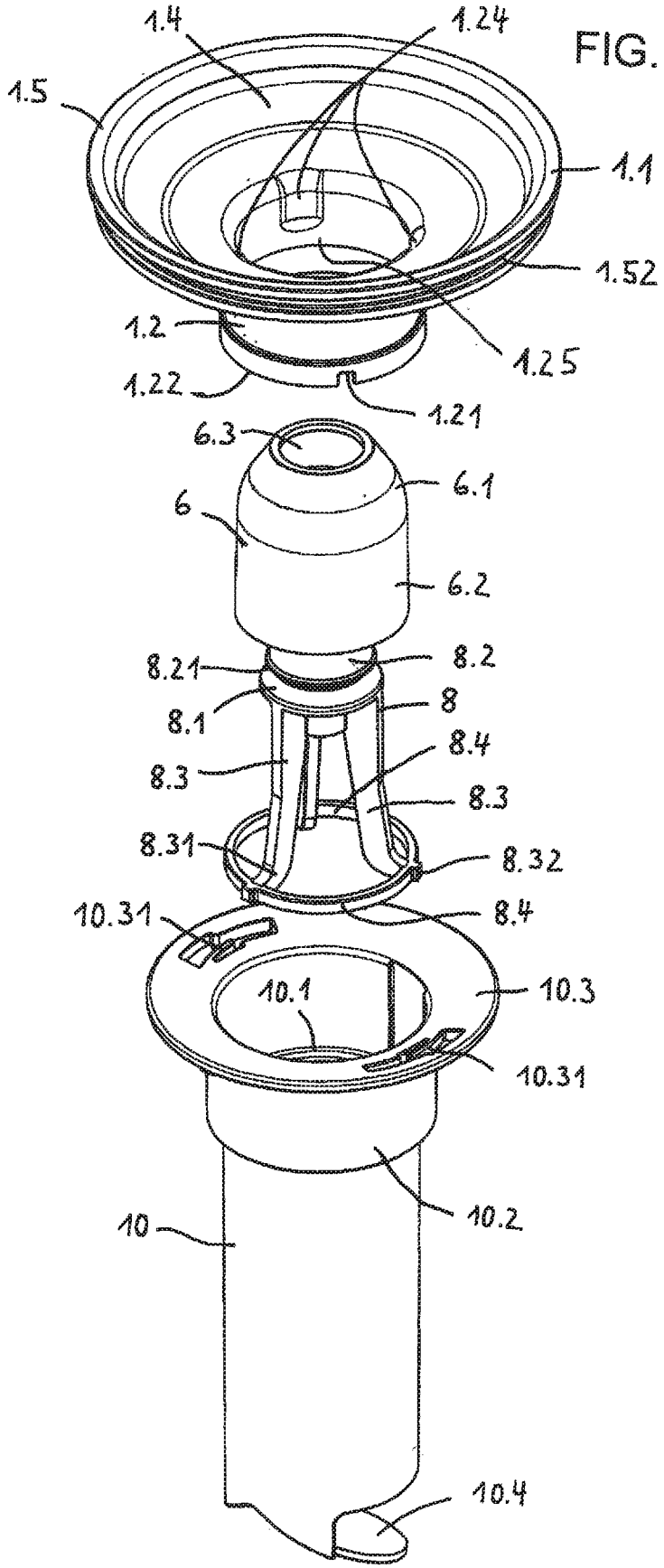
FIG. 12 shows the odor trap device from FIGS. 9 and 10 in a perspective explosion view.
Figure 14:
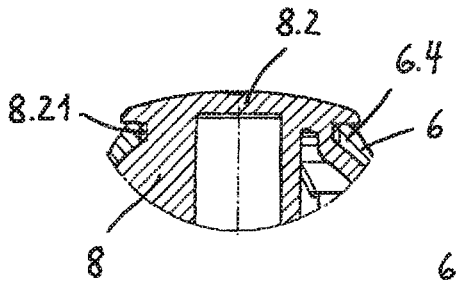
FIG. 14 shows an enlarged view of detail C from FIG. 13.

The outside of the accumulation section 6.1 of the sealing diaphragm 6 delimits with the pipe section 1.2 an annular, uninterrupted inlet channel 9, which tapers towards zero when viewed in the direction of flow (cf. in particular FIG. 7). This ensures that even small amounts of urine or liquid are safely discharged. Viewed in cross-section, the inlet channel 9 is substantially gusset-shaped, since the accumulation section 6.1 has a curved, preferably spherical section-shaped outer surface and thereby defines an arcuate outer contour, while the pipe section 1.2 has a cylindrical inner surface and thereby defines a straight line which, viewed in cross-section, touches the arcuate outer contour of the accumulation section 6.1 of the sealing diaphragm.

The pipe section 1.2 is inserted into a pipe section extension 10, which is detachably connected to the drainage element 1.1. The pipe section extension 10 can also be described as a tubular guide body. The pipe section extension 10 runs vertically, ends at a distance above the bottom 2.2 of a drain interior 2.3 of the sanitary object 2 and is formed preferably substantially straight (FIG. 2). On the inside it has a shoulder 10.1 on which the holder 8 for bearing the sealing diaphragm 6 is supported. The upper section 10.2 of the pipe section extension 10 is designed in the manner of a sleeve to accommodate the pipe section 1.2. The upper end of the pipe section extension 10 has a circumferential flange 10.3, which, when the pipe section extension 10 is mounted, rests against the underside of the inlet funnel 1.4.

The pipe section extension 10 and the drainage element 1.1 are provided with latching elements 10.31, 1.9 assigned to one another. The latching elements 10.31, 1.9 are designed in such a way that they can be latched together by a rotary movement of the drainage element 1.1 relative to the pipe section extension 10. The latching elements 10.31, 1.9 consist, for example, of curved openings formed in the flange 10.3 of the pipe section extension 10 with spring-elastic latching lugs and latching projections 1.9 which can be inserted into or connected to them and which project downwards from the underside of the inlet funnel 1.4 (see FIGS. 4 and 5).

By means of the pipe section extension 10 a flow resistance is provided which creates an accumulation zone for the liquid flowing off, e.g. urine. For this purpose, the pipe section extension 10 is provided at its lower end with a baffle element or deflection element 10.4, which acts as flow resistance for the liquid flowing off. For example, the baffle element or deflection element 10.4 has a conical shape with the tip of the cone pointing upwards. The baffle element or deflection element 10.4 is connected to a hollow cylindrical section 10.6 of the pipe section extension 10 via several substantially vertically extending retaining webs 10.5. If the liquid column in this accumulation zone is sufficiently high, the liquid pressure rises to such an extent that the liquid flows out of this zone. Due to the gravity of the liquid flowing off, a suction effect is created which pulls the liquid above the sealing surface of the odor trap downwards into the pipe section extension 10 more quickly.

A hood-shaped plate 11 is arranged as a cover above the drainage element 1.1, wherein the plate 11 is detachably connected via spring-loaded spacers 11.1 to the drainage element 1.1 or the ring-shaped or bushing-shaped adapter 4. The cover 11 is substantially circular disc-shaped and protrudes laterally along its entire outer circumference beyond the drainage element 1.1. The spring-elastic spacers 11.1 are moulded onto a carrier plate 11.2, which is provided with a cap-like cover element 11.3 on the upper side. The cover 11 or the cover element 11.3 can perform a design function.

A further embodiment of the odor trap device according to the invention is shown in FIGS. 9 to 15. Components of this device which correspond to the components of the odor trap device shown in FIGS. 1 to 8 or have the same or a similar function are provided with the same reference numbers. With regard to these components, in order to avoid repetitions, reference is made to the previous description concerning FIGS. 1 to 8.

Figure 4:
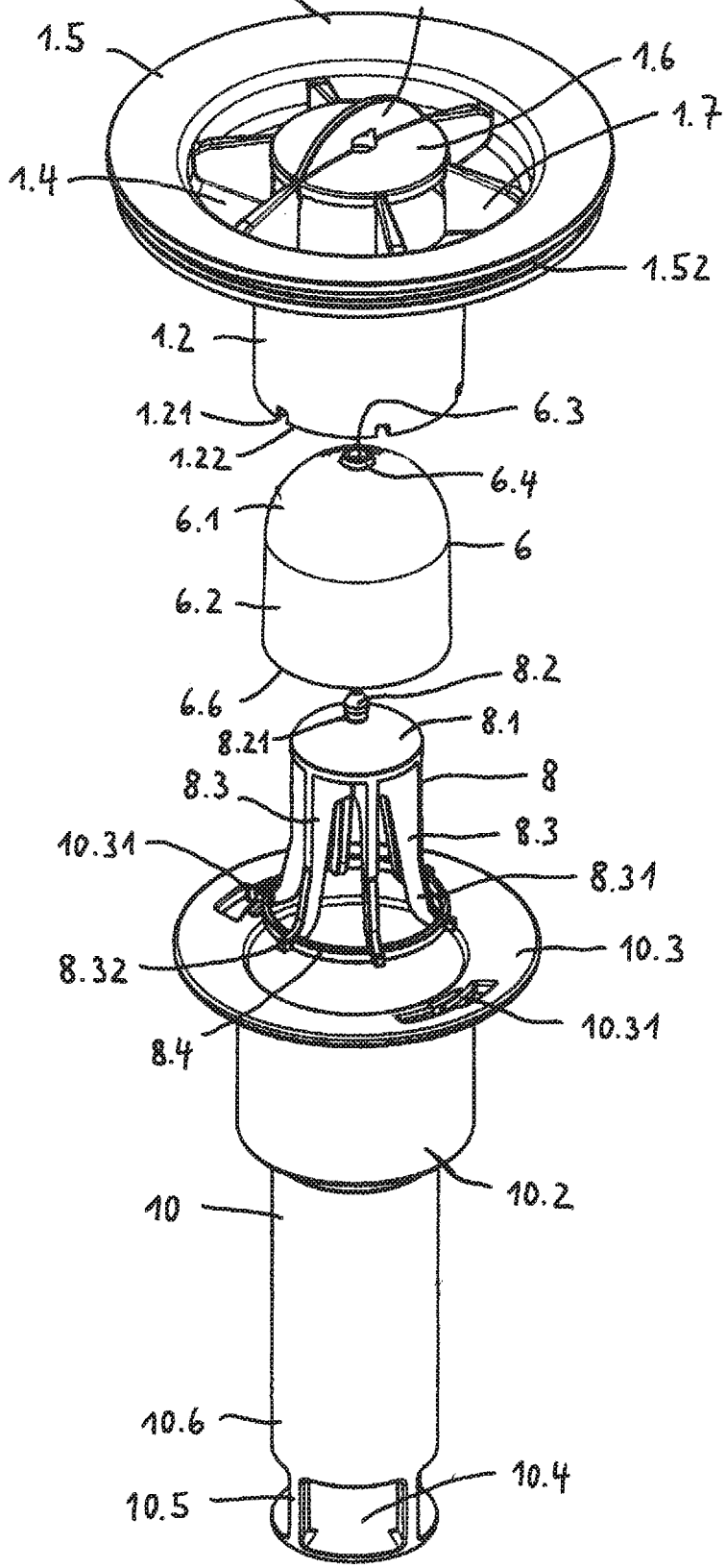
FIG. 4 shows the odor trap device from FIGS. 1 and 2 in a perspective explosion view.
Figure 6:
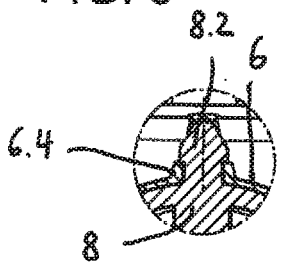
FIG. 6 shows an enlarged representation of detail A from FIG. 5.

The drainage element 1.1 of the odor trap device shown in FIGS. 9 to 13 differs from the drainage element 1.1 in FIG. 4 in that here neither the webs 1.7 nor the plate-shaped part 1.6 with the projection (handle) 1.61 formed on the webs 1.7 are present. However, the drainage element 1.1, which can be clearly seen in FIGS. 12 and 13, again has a pipe section 1.2 which defines a sealing wall 1.3 on the inside. An inlet funnel 1.4 is integrally formed on the pipe section 1.2, which descends less steeply than the inlet funnel 1.4 in FIG. 5 in the direction of the pipe section 1.2.

The pipe section 1.2 of the drainage element 1.1 from FIGS. 9 to 13 has inlet channels 1.24 on the inside (FIG. 12) which, starting from the inlet opening 5 of the pipe section 1.2, extend substantially vertically in the direction of the sealing wall 1.3 and end above the sealing surface 1.25 defined by the sealing wall 1.3. The inlet channels 1.24 are radially formed into the inside of the pipe section and preferably distributed evenly over the inner circumference of the pipe section 1.2.

A sealing diaphragm 6 is in turn fixed to a holder 8, wherein the holder 8 is supported below the sealing diaphragm 6. For this purpose, the pipe section extension 10 has a shoulder 10.1 on the inside. To fix the sealing diaphragm 6 on the holder 8, the sealing diaphragm 6 has an opening 6.3 at the top, which is or will be buttoned onto a plate-shaped or button-shaped projection 8.2 of the holder 8. An annular groove 8.21 is formed on the plate-shaped or button-shaped projection 8.2, into which the sealing diaphragm 6 engages in a sealing manner.

The sealing diaphragm 6 and the height of the holder 8 are dimensioned so that the substantially hollow cylindrical section 6.2 of the sealing diaphragm extends from the lower edge 6.6 of the sealing diaphragm 6 to the inlet funnel 1.4. The section 6.1 of the sealing diaphragm 6, which tapers towards the opening 6.3 has substantially the shape of a hollow ball segment, for example. However, section 6.1, which tapers upwards, may have a different rotationally symmetrical shape.

Figure 15:
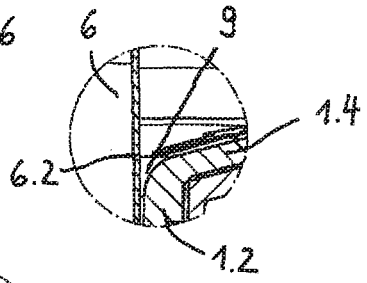
FIG. 15 shows an enlarged view of detail D from FIG. 13.
Figure 13:
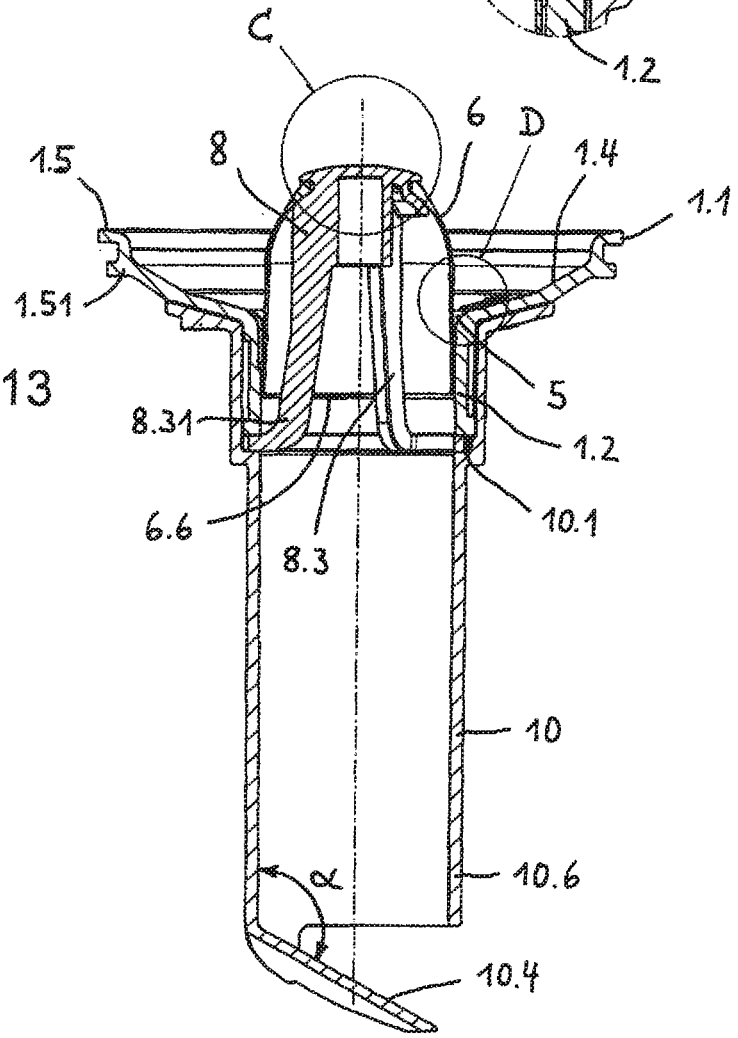
FIG. 13 shows the odor trap device from FIGS. 9 and 10 in a vertical sectional view.

In FIG. 15 it can be seen that the substantially hollow cylindrical section 6.2 of the sealing diaphragm delimits with the rounded transition of the inlet funnel 1.4 in the direction of the pipe section 1.2 an annular inlet channel 9, which tapers towards zero when viewed in the discharge direction. In this case the inlet channel 9 is extended radially and axially by the inlet channels 1.24.

The pipe section extension 10 shown in FIGS. 10 to 13 differs from the pipe section extension 10 shown in FIGS. 2 to 5 with respect to the design of the baffle element or deflection element 10.4. The baffle element or deflection element 10.4 here is formed from a flap-shaped extension of the pipe section extension 10 which projects downwards relative to the lower end of the tubular section of the pipe section extension 10 and is angled obliquely in the direction of the pipe centre axis. In this case the baffle element or deflection element 10.4 is substantially disc-shaped. The angle $\alpha$, which the disc-shaped baffle element impact or deflection element 10.4 encloses with the pipe wall and the pipe centre axis of the pipe section extension 10, is, for example, in the range from 100° to 130°, preferably in the range from 110° to 125°.

The execution of the invention is not limited to the embodiments shown in the drawing. Rather, numerous variants are conceivable which also make use of the invention stated in the attached claims even if the design deviates from the design of the embodiment shown.

The invention claimed is:

1. An odor trap device for sanitary fixtures, in particular urinals, having a drainage element which has a pipe section, the pipe section defining a sealing wall, having a sealing diaphragm which is in sealing contact with the sealing wall in a closed position and is pushed away from the sealing wall into an open position by backed-up fluid, such as urine, and having a holder for mounting the sealing diaphragm relative to the sealing wall, the sealing diaphragm is fixed on the holder, the holder being supported below the sealing diaphragm, characterized in that the holder is in contact with the pipe section below the sealing diaphragm.

2. The odor trap device according to claim 1, characterized in that the sealing diaphragm has a rubber-elastic, upwardly tapering accumulation section and a rubber-elastic, substantially hollow-cylindrical section adjoining the accumulation section as seen in the discharge direction, the outside of the accumulation section delimiting with the pipe section an annular, uninterrupted inlet channel which tapers towards zero as seen in the discharge direction.

3. The odor trap device according to claim 1, characterized in that the sealing diaphragm is fixed to a projection of the holder, the projection being arranged on the upper side or tip of the holder and having an annular groove or undercut to which the sealing diaphragm is sealingly buttoned.

4. The odor trap device according to claim 1, characterized in that the holder has a domed or spherical-segment-shaped section on which the sealing diaphragm rests.

5. The odor trap device according to claim 1, characterised in that the holder has support legs which are spaced to the inner surface of the sealing diaphragm and project downwards with respect to a lower edge of the sealing diaphragm.

6. The odor trap device according to claim 5, characterized in that the support legs are connected to one another by transverse struts.

7. The odor trap device according to claim 6, characterized in that the transverse struts are arranged below the lower edge of the sealing diaphragm.

8. The odor trap device according to claim 5, characterised in that the support legs have an outwardly angled or obliquely outwardly extending leg section.

9. The odor trap device according to claim 1, characterized in that the pipe section has recesses in which the holder engages.

10. The odor trap device according to claim 1, characterized in that a hood-shaped or cap-shaped cover is arranged above the drainage element and is detachably connected to the drainage element via spacers.

11. The odor trap device according to claim 10, characterized in that the cover laterally projects beyond the drainage element along its entire outer periphery.

12. The odor trap device according to claim 1, characterized in that the pipe section is inserted into a pipe section extension, the pipe section extension being detachably connected to the pipe section and/or the drainage element.

13. The odor trap device according to claim 12, characterized in that the pipe section extension has a shoulder on the inside on which the holder is supported.

14. The odor trap device according to claim 12, characterized in that the pipe section extension and the discharge element have latching elements assigned to one another.

15. The odor trap device according to claim 14, characterized in that the latching elements can be latched together by a rotational movement of the discharge element relative to the pipe section extension.

* * * * *